US007753303B2

(12) United States Patent
Hall et al.

(10) Patent No.: US 7,753,303 B2
(45) Date of Patent: Jul. 13, 2010

(54) ROTARY SHAFT IMPACTOR

(76) Inventors: David R. Hall, 2185 S. Larsen Pkwy., Provo, UT (US) 84606; Ronald Crockett, 2185 S. Larsen Pkwy., Provo, UT (US) 84606; Joe Fox, 2185 S. Larsen Pkwy., Provo, UT (US) 84606

( * ) Notice: Subject to any disclaimer, the term of this patent is extended or adjusted under 35 U.S.C. 154(b) by 625 days.

(21) Appl. No.: 11/534,177

(22) Filed: Sep. 21, 2006

(65) Prior Publication Data

US 2008/0135660 A1 Jun. 12, 2008

(51) Int. Cl.
*B02C 19/00* (2006.01)

(52) U.S. Cl. ..... 241/275; 241/300

(58) Field of Classification Search ..... 241/275, 241/300

See application file for complete search history.

(56) References Cited

U.S. PATENT DOCUMENTS

| | | | | |
|---|---|---|---|---|
| RE029,798 | E | 10/1978 | Johnson | |
| 4,397,426 | A | 8/1983 | Warren | |
| 4,560,113 | A | 12/1985 | Szalanski | |
| 4,575,014 | A | 3/1986 | Szalanski | |
| RE032,363 | E | 2/1987 | Warren | |
| 4,659,026 | A | 4/1987 | Krause | |
| 4,756,484 | A | 7/1988 | Bechler | |
| 4,787,564 | A * | 11/1988 | Tucker | 241/275 |
| 4,796,822 | A | 1/1989 | Terrenzio | |
| 4,877,192 | A | 10/1989 | Rossouw | |
| 4,896,838 | A | 1/1990 | Vendelin | |
| 4,940,188 | A | 7/1990 | Rodriguez | |
| 5,029,761 | A | 7/1991 | Bechler | |
| 5,184,784 | A * | 2/1993 | Rose et al. | 241/275 |
| 5,323,974 | A | 6/1994 | Watajima | |
| 5,497,951 | A | 3/1996 | Watajima | |
| 5,639,030 | A | 6/1997 | Watajima | |
| 5,911,370 | A | 6/1999 | Lusty | |
| 6,070,815 | A * | 6/2000 | Miyatake | 241/47 |
| 6,135,373 | A * | 10/2000 | Davenport | 241/30 |
| 6,171,713 | B1 | 1/2001 | Smith | |
| 6,554,215 | B1 | 4/2003 | Schultz | |
| 6,601,789 | B1 | 8/2003 | Bajadali | |
| 6,742,735 | B2 * | 6/2004 | Sollami | 241/294 |
| 6,783,092 | B1 | 8/2004 | Robson | |
| 7,028,936 | B2 | 4/2006 | Condon | |
| 7,416,146 | B2 * | 8/2008 | Britzke | 241/300 |
| 2003/0025020 | A1 * | 2/2003 | Britzke | 241/275 |
| 2004/0011906 | A1 | 1/2004 | Bajadali | |
| 2004/0113002 | A1 * | 6/2004 | Tessier et al. | 241/275 |
| 2005/0150987 | A1 | 7/2005 | Hur | |
| 2005/0211810 | A1 | 9/2005 | Condon | |
| 2005/0263636 | A1 | 12/2005 | Hur | |
| 2006/0011762 | A1 | 1/2006 | Dallimore | |

* cited by examiner

*Primary Examiner*—Faye Francis
(74) *Attorney, Agent, or Firm*—Tyson J. Wilde; Philip W. Townsend, III

(57) ABSTRACT

A rotary shaft impactor, has a rotor assembly connected to a rotary driving mechanism. The rotor assembly has an axis of rotation, an inlet, and an outlet, and is disposed within a chamber with an inner wall. A wear path has a portion of the inner wall and a channel connecting the inlet and the outlet. At least a portion of the wear path has a diamond surface. The inner wall may also have a shelf

14 Claims, 18 Drawing Sheets

ROTARY SHAFT IMPACTOR

BACKGROUND OF THE INVENTION

Rotary shaft impactors are generally used to reshape or reduce the size of aggregate material. Rotary shaft impactors operate on the principle of propelling the aggregate at high velocity against a target or against other aggregate. The aggregate is generally fed through an inlet into a rotor assembly which rotates at high velocity, accelerating the aggregate out of an outlet of the rotor assembly and into a plurality of targets, sometimes referred to in the art as anvils, disposed along an inner wall of a chamber in which the rotor assembly is disposed. Because of the high velocity of the aggregate both in the rotor assembly and toward the targets, different components of the rotary shaft impactor experience high wear from the aggregate.

U.S. Pat. No. 5,029,761 by Bechler, which is herein incorporated by reference for all that it contains, discloses a liner wear plate for a vertical shaft impactor rotor including at least one wear resistant insert disposed in the liner along a path of wear formed by particulate material passed through said rotor for communication.

U.S. Pat. No. 6,171,713 by Smith et al., which is herein incorporated by reference for all that it contains, discloses an impeller shoe having a front wide with a series of half column members and raised upper and lower rims that form the impact surface of the impeller shoe. The half column and raised rims are formed with carbide material formed therein in order to improve wear resistance at these critical surfaces.

U.S. Pat. No. 6,783,092 by Robson, which is herein incorporated by reference for all that it contains, discloses an anvil for use in rock crushers.

BRIEF SUMMARY OF THE INVENTION

A rotary shaft impactor, comprises a rotor assembly connected to a rotary driving mechanism. The rotor assembly comprises an axis of rotation, an inlet, and an outlet, and is disposed within a chamber with an inner wall. A wear path comprises a portion of the inner wall and a channel connecting the inlet and the outlet. At least a portion of the wear path comprises a diamond surface. The inner wall may also comprise a shelf.

The diamond surface may be on an edge disposed in the wear path and proximate the outlet. The edge may have a geometry comprising a L-shaped surface, a flat surface, a concave surface, a twisted surface, a grooved surface, an asymmetric surface, or combinations thereof. The diamond surface may be on an impeller shoe disposed along the wear path and intermediate the inlet and the outlet. The diamond surface may be on a plurality of targets disposed along the inner wall of the chamber. The targets may comprise a geometry with a generally triangular shape, a generally square shape, a generally wedge shape, a generally scoop shape, a generally polygonal shape, a generally concave shape, a generally convex shape, a chamfer, or combinations thereof.

The diamond surface may be on an outer surface of the rotor assembly. The diamond surface may be bonded to an insert. The insert may comprise a geometry with an elliptic paraboloid shape, a generally rounded shape, a generally conical shape, a generally pyramidal shape, a generally triangular shape, a generally frustoconical shape, a generally flat shape, a generally asymmetric shape, a generally domed shape, a generally wedge shape, a generally scoop shape, a general polygonal shape, a generally rectangular shape, a generally concave shape, a generally convex shape, a chamfer, a conic section, or combinations thereof. A plurality of inserts may be positioned in the wear path in staggered rows. The insert may comprise a central axis that forms an acute angle with a surface of the wear path. The insert may protrude beyond a surface of the wear path by 0.010 to 3.00 inches. The insert may be brazed or press fit into a recess formed in a portion of the wear path.

The diamond surface may be bonded to a non-planar interface of the insert. The diamond surface may comprise a binder concentration less than 40 weight percent. The diamond surface may comprise an unequal distribution of binder concentration for bonding purposes. The diamond surface may comprise an average grain size of 0.5 to 300 microns. The diamond surface may comprise a polish finish. The diamond surface may be selected from the group consisting of natural diamond, synthetic diamond, polycrystalline diamond, vapor deposited diamond, layered diamond, infiltrated diamond, thermally stable diamond, diamond impregnated carbide, diamond impregnated matrix, silicon bonded diamond, and combinations thereof.

DETAILED DESCRIPTION OF THE INVENTION AND THE PREFERRED EMBODIMENT

Figure 1:
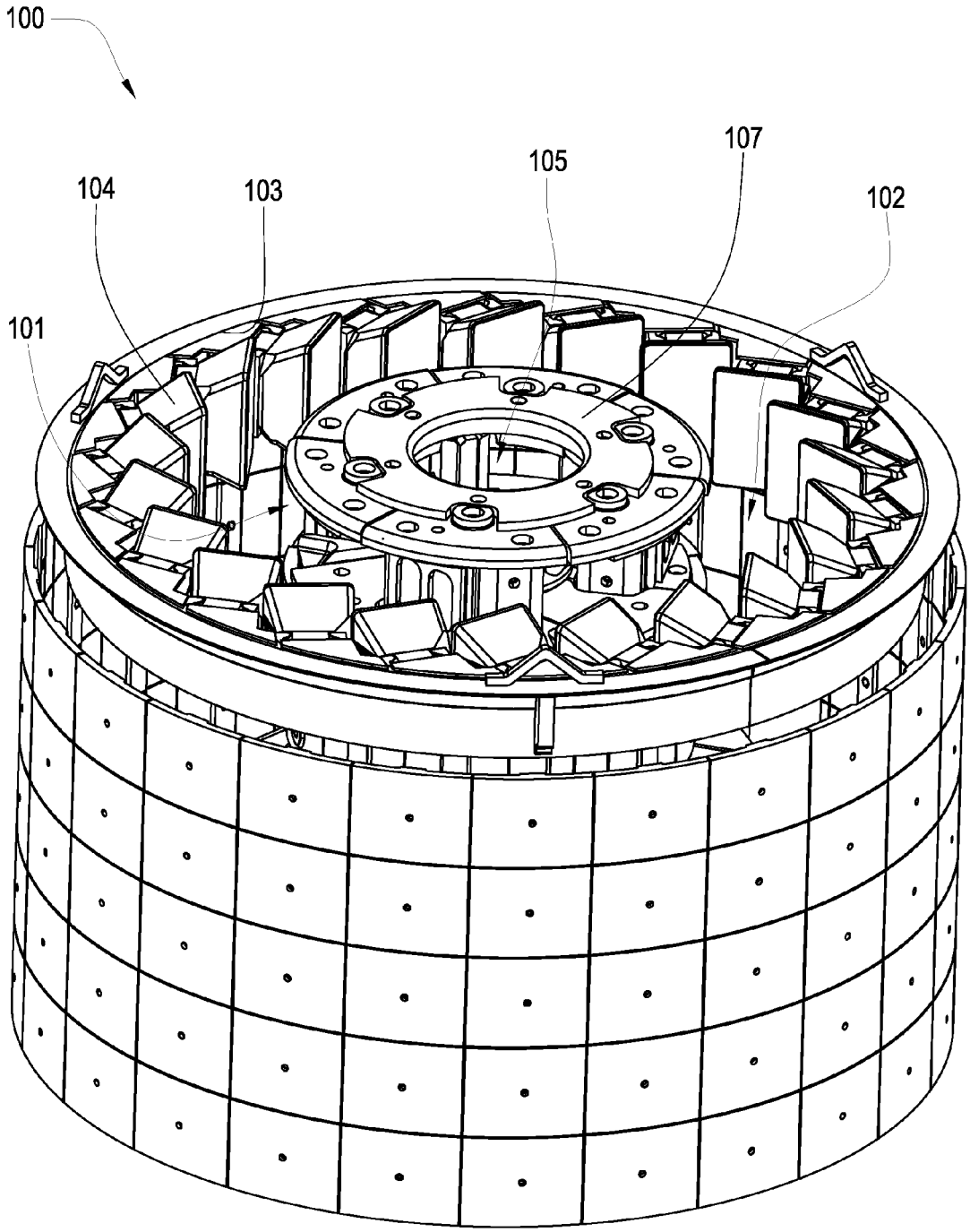
FIG. 1 is a perspective diagram of an embodiment of a rotary shaft impactor.

FIG. 1 is an embodiment of a rotary shaft impactor 100, specifically a vertical shaft impactor, for resizing or reshaping aggregate. A rotor assembly 101 may be disposed within a chamber 102 comprising an inner wall 103 with a plurality of targets 104 attached to the inner wall 103. The rotor assembly 101 may comprise a feed plate 107 with an inlet 105 where aggregate may be inserted. As the rotor assembly 101 rotates, generally between 600 and 2000 rpm, the aggregate is ejected centrifugally from an outlet of the rotor assembly 101 toward the targets 104 along the inner wall 103. The rotor assembly 101 may be connected to a rotary driving mechanism. The rotary driving mechanism may be a motor or an engine.

Aggregate impacting against the targets 104 is crushed and resized into smaller pieces. This impact may cause the targets 104 to wear and necessitate the replacement of some or all of the targets 104 regularly.

In some embodiments, the vertical shaft impactor 100 may include a shelf proximate the inner wall 103. This shelf may replace the targets or the shelf may be beneath the targets 104. Portions of the crushed aggregate may land and remain on the shelves. Aggregate impacting against crushed aggregate remaining on the shelf generally results in smoothing or reshaping the aggregate. The aggregate remaining on the shelf may also be crushed by the later aggregate centrifugally ejected. Impactors 100 comprising the shelf are referred to in the industry as autogenous impactors, and may be advantageous with more abrasive aggregate. In other embodiments, the rotary shaft impactor 100 may not have the shelf beneath the targets 104. In such embodiments, referred to in the industry as standard impactors, the aggregate impacts against the targets 104 and falls, leaving the targets 104 exposed to a continuous flow of aggregate, resizing the aggregate into smaller particles of generally similar sizes.

Figure 2:
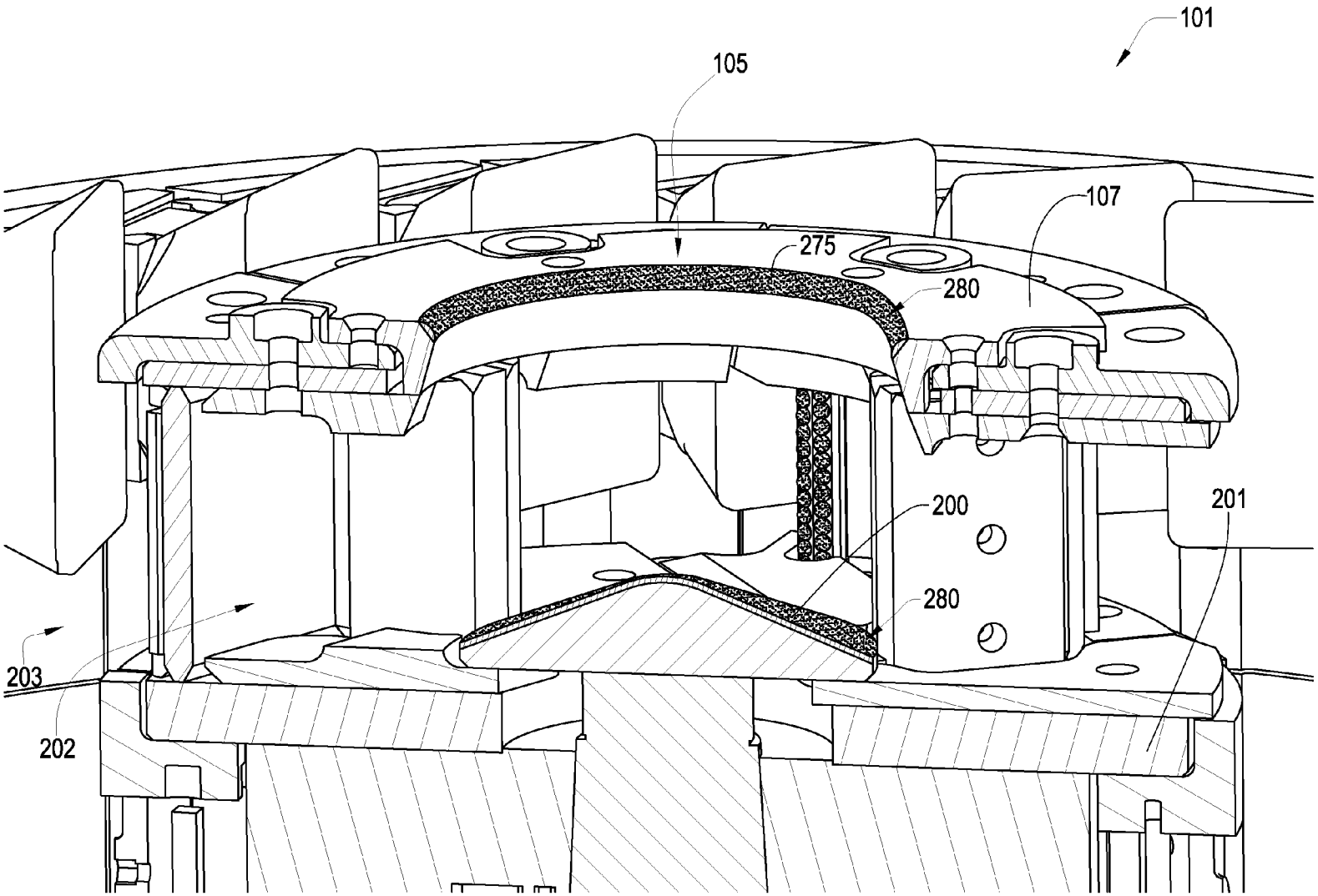
FIG. 2 is a cross-sectional diagram of an embodiment rotary shaft impactor.

Referring to FIG. 2, the rotor assembly 101 may comprise a deflector 200, such as a cone, or other component in the center of a base plate 201 for directing the flow of aggregate. The aggregate follows a wear path comprising a channel 202 connecting the inlet 105 of the rotor assembly 101 to an outlet 203 of the rotor assembly 101. The wear path also comprises the inner wall 103 of the chamber 102. Any component of the rotor assembly 101 along the wear path 202 may experience wear due to impact or friction from the aggregate moving at high velocities. Any portion of the rotary shaft impactor 100 that is disposed within the wear path may comprise a diamond surface 280, such as exposed surfaces 275 of the feed plate 107 near the inlet or the surface of the deflector 200.

Figure 3:
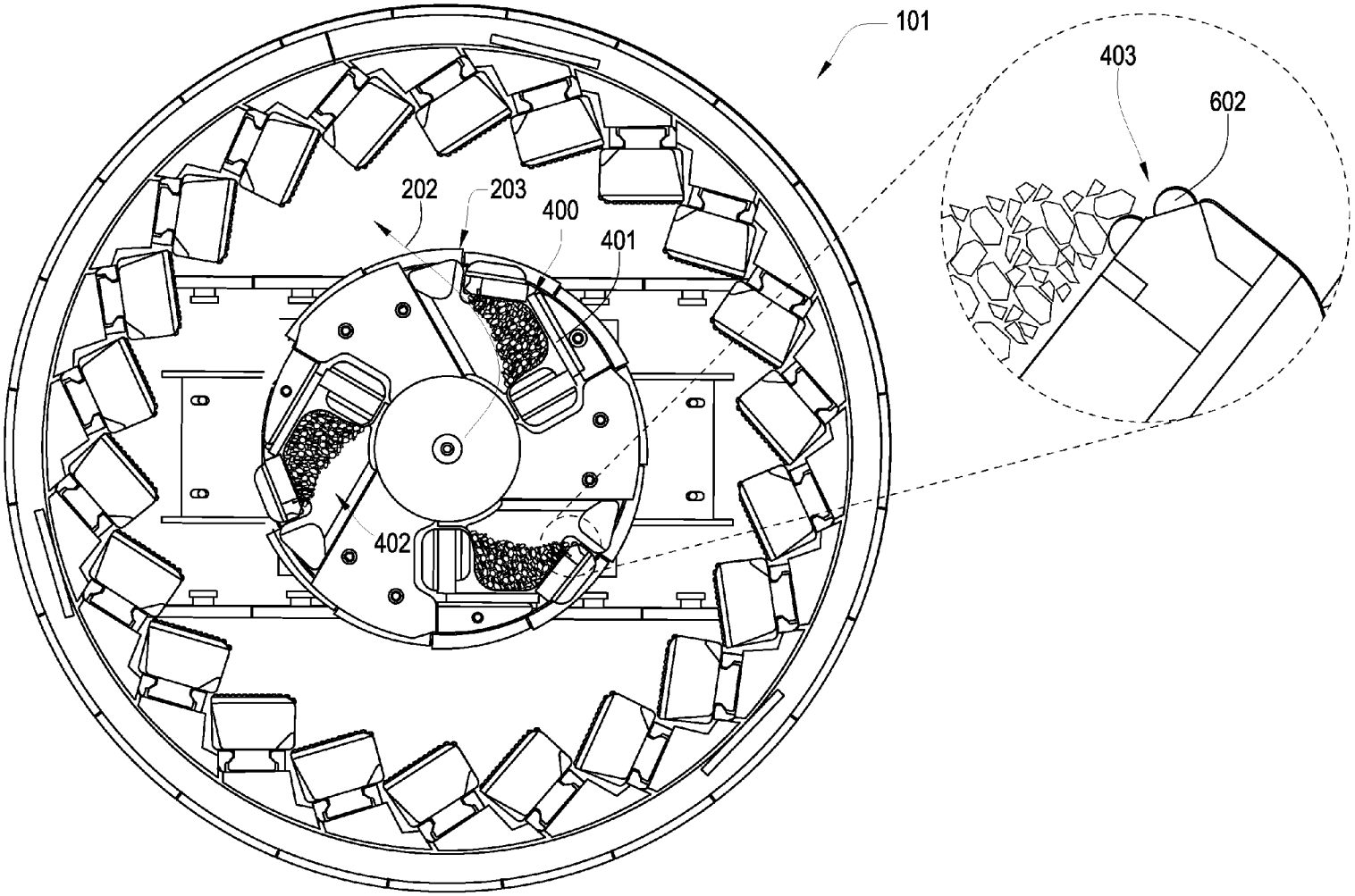
FIG. 3 is a top diagram of an embodiment of a rotor assembly.

The rotor assembly 101 in the embodiment of FIG. 3 is an autogenous rotor assembly 101 generally used in either autogenous or semi-autogenous impactors. The rotor assembly 101 may comprise one or more pockets 400 formed in one or more peripheral plates 401 disposed along a portion of the wear path between the inlet and the outlet. Aggregate 402 fills the pockets, lining the peripheral plates 401 and protecting the plates from wear, and also acting to smooth or reshape other aggregate 402. The rotor assembly 101 may also comprise an edge 403 secured to the peripheral plates 401 along the wear path 202 and proximate the outlet 203. The edge 403 may protect the peripheral plates 401 near the outlet 203. The edge 403 may also break the aggregate 402 as the aggregate 402 flows from the inlet 105 to the outlet 203. The edge 403 may comprise an insert 602 with a diamond surface to protect the edge from wear.

Figure 4:
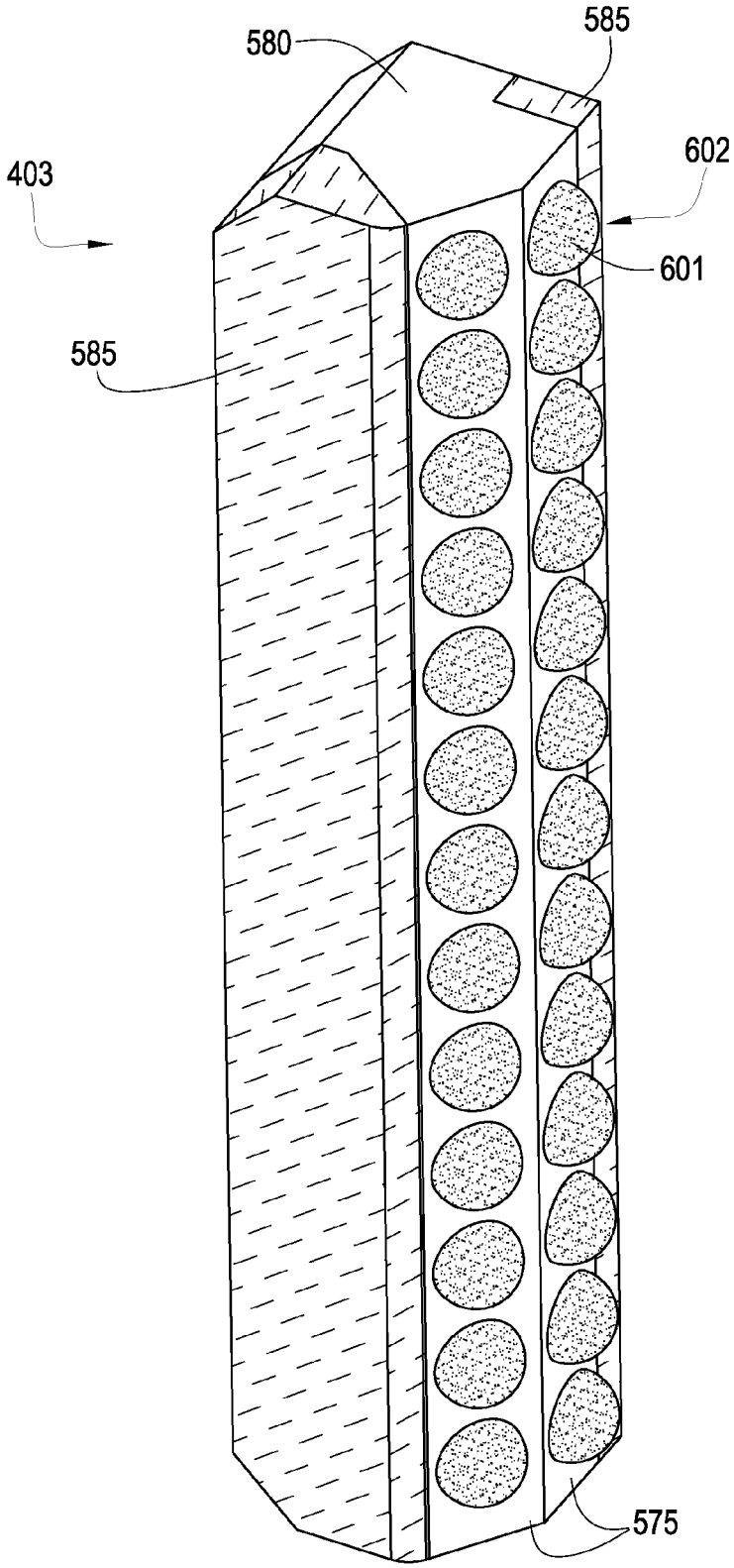
FIG. 4 is a perspective diagram of an embodiment of an edge.

Referring to the embodiment of FIG. 4, the edge 403 may comprise a diamond surface 601 in the wear path. The diamond surface 601 may be bonded to an insert 602. The edge 403 may comprise a plurality of inserts 602 positioned in a row or rows along surfaces 575 of the edge 403. The inserts 602 may be brazed or press fit into recesses formed in the edge 403. The inserts 602 may protrude beyond the surface 575 of the edge 403 by 0.010 to 3.00 inches, or the inserts 602 may be flush with the surface 575. The edge 403 may be made of steel, stainless steel, carbide, manganese, hardened steel, chromium, tungsten, tantalum, niobium, molybdenum, or combinations thereof. A steel body 580 may provide strength to the edge 403, while a harder material 585 at high wear regions of the edge 403 may provide wear resistance, allowing for protection from impact and shearing forces due to the flow of aggregate. The surfaces 575 of the edge 602 may also comprise a surface coating with a hardness greater than 58 HRc.

Figure 5:
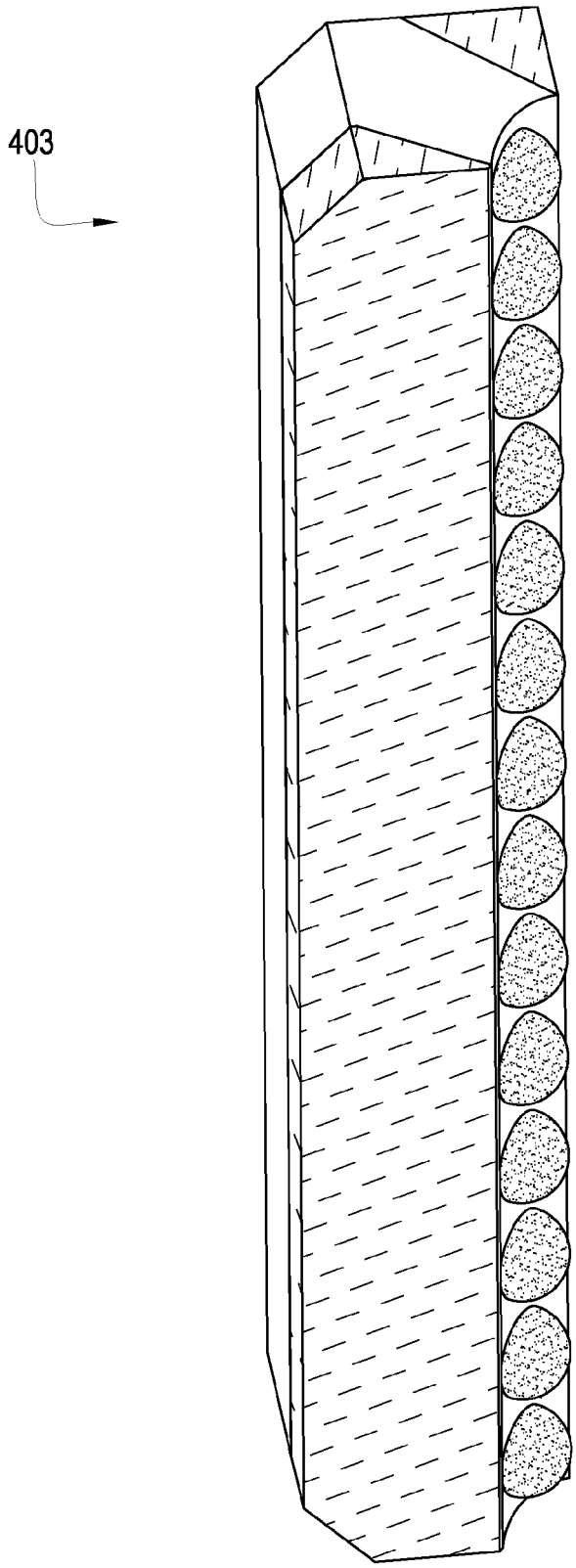
FIG. 5 is a perspective diagram of another embodiment of an edge.

The edge 403 may have a geometry comprising a L-shaped surface; a concave surface; such as in the embodiment of FIG. 5; a twisted surface; a triangular surface; a flat surface; a grooved surface; an asymmetric surface; or combinations thereof. In addition, the edge 403 may comprise a rectangular insert 1050 that spans a length of the edge, as in the embodiment of FIG. 6.

Figure 7:
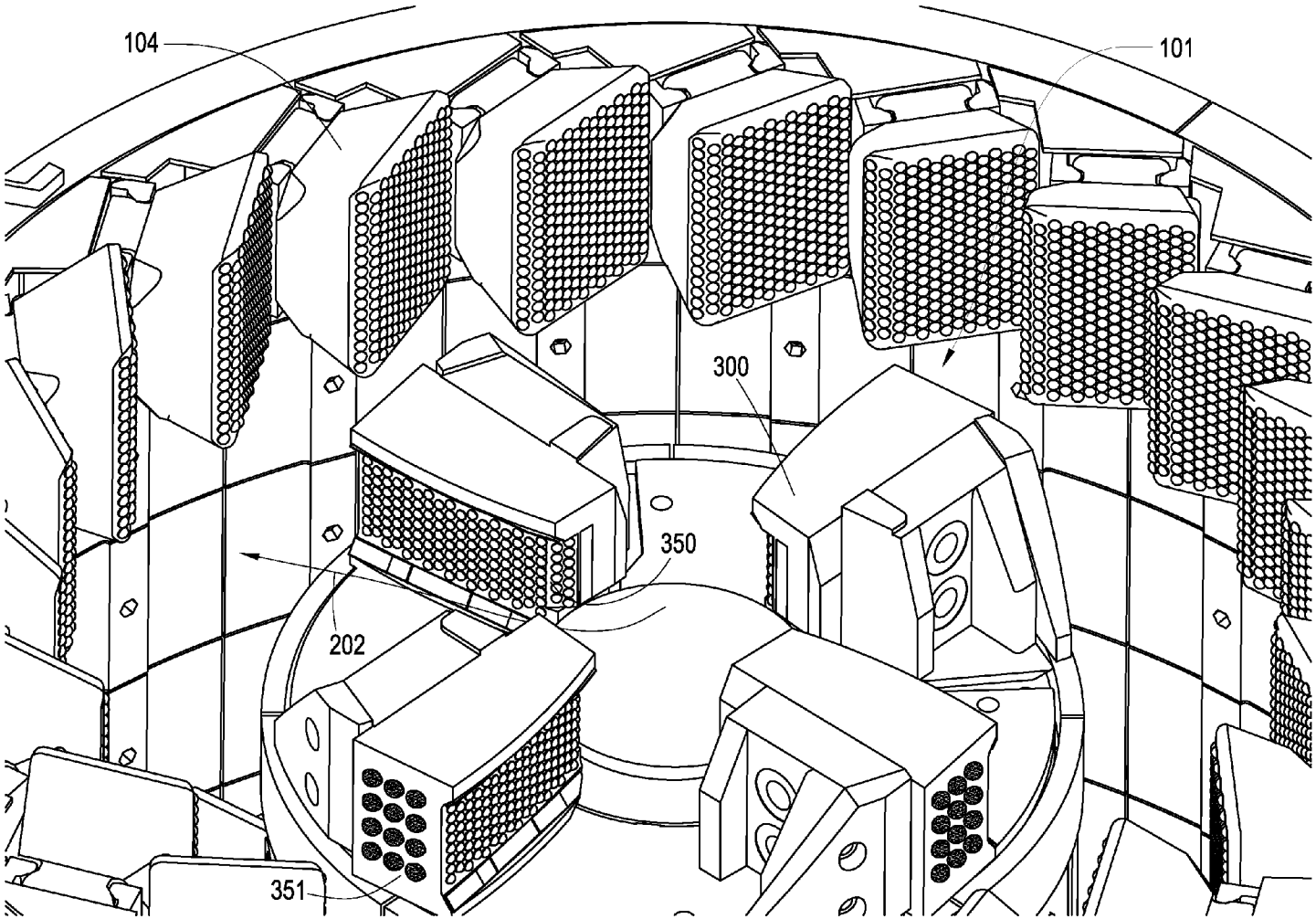
FIG. 7 is an orthogonal diagram of another embodiment of a rotor assembly.

FIG. 7 is an embodiment of a rotor assembly 101 without the feed plate 107. The rotor assembly 101 may comprise one or more impeller shoes 300 along the channel 202. As the rotor assembly 101 spins, the aggregate follows the channel 202, signified by the arrows, and the shoes 300 in conjunction with the rotation of the rotor assembly 101 cause the aggregate to be ejected from the rotor assembly 101 along the wear path toward the targets 104 at a high velocity. The flow of aggregate causes a surface 350 of the impeller shoes 300 to experience wear that reduces the efficiency of the rotor assembly 101 and eventually degrades the shoes 300 beyond usability, causing the need for their replacement. The shoes 300 may be attached to the rotor assembly 101 by support brackets, allowing the shoes 300 to be easily removable from the rotor assembly 101 for replacement. Also, an outer surface of the rotor assembly 101 may experience wear due to aggregate rebounding off of the targets 104 and impacting against the outer surface 351. The outer surface 351 may comprise a diamond impregnated surface or inserts with a diamond surface.

Figure 8:
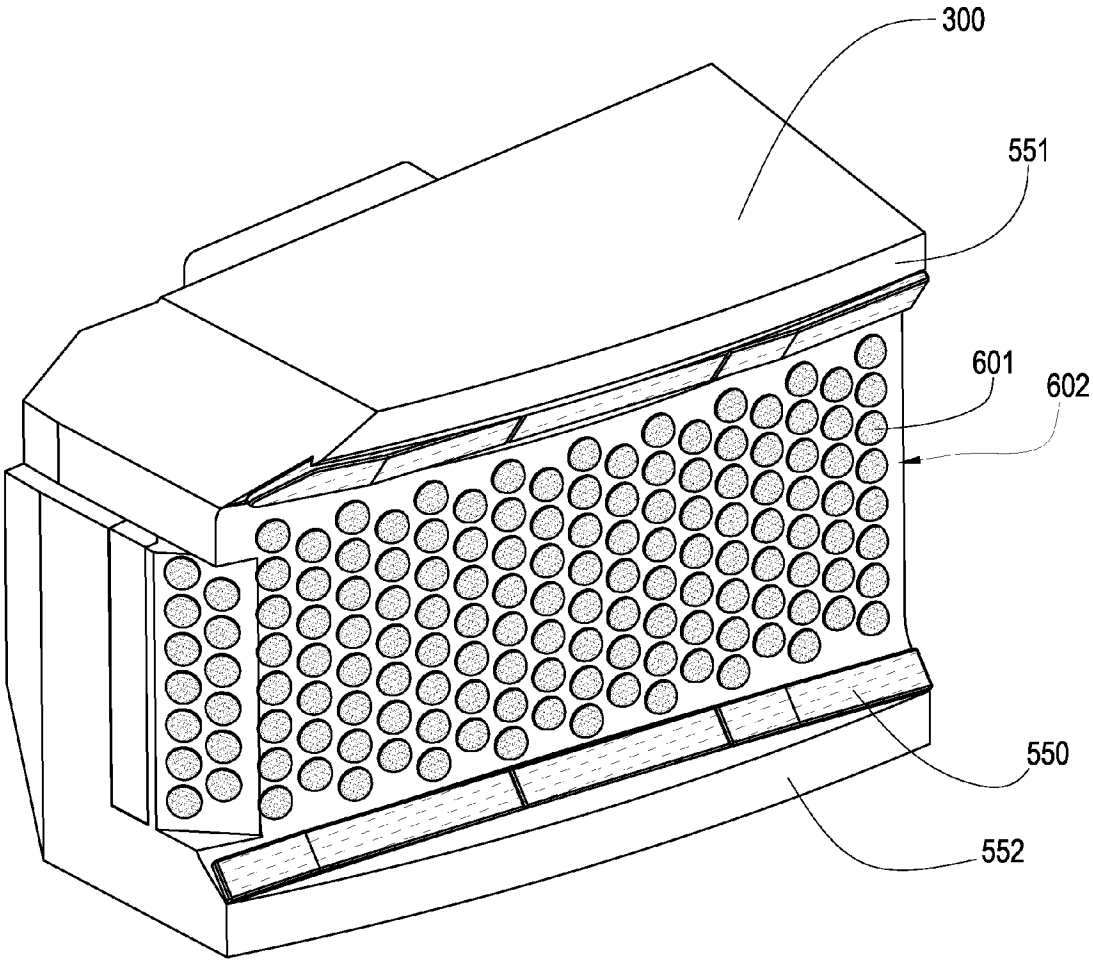
FIG. 8 is a perspective diagram of an embodiment of an impeller shoe.

Referring now to FIG. 8, in order to prevent wear to the impeller shoes 300, the impeller shoe 300 may comprise a diamond surface 601 along the wear path. The diamond surface 601 may be selected from the group consisting of natural diamond, synthetic diamond, polycrystalline diamond, vapor deposited diamond, layered diamond, infiltrated diamond, thermally stable diamond, diamond impregnated carbide, diamond impregnated matrix, silicon bonded diamond, cobalt bonded diamond, and combinations thereof. The diamond surface 601 may comprise a binder concentration of up to 40 percent, which may help the diamond surface 601 better absorb impact forces from the flow of aggregate. The binder concentration may be unequally distributed throughout the diamond surface 601 allowing better bonding to another material while maintaining strength at exposed regions. The diamond surface 601 may comprise an average grain size of 0.5 to 300 microns. The diamond surface 601 may also comprise a polish finish, which may reduce friction and heat.

The diamond surface 601 may be attached to an insert 602. The diamond surface may be bonded to a non-planar interface of the insert 602. The insert 602 may be brazed, glued, or press fit into a recess formed in the impeller shoe 300. The insert 602 may protrude beyond a surface 350 on the shoe by 0.010 to 3.00 inches, or the insert 602 may be flush with the surface 350. The insert 602 may also be bonded to a corner joining at least two surfaces of the shoe 300. The shoe 300 may also comprise a plurality of inserts 602 positioned on the impeller shoe 300 in staggered rows. This may allow the inserts 602 to cover more surface area of the impeller shoe 300, which may aid in wear prevention.

The impeller shoe 300 may also comprise strips 550 or coatings of material with a hardness less than that of diamond. The strips of material may be selected from the group consisting of chromium, tungsten, tantalum, niobium, titanium, molybdenum, carbide, cubic boron nitride, TiN, AlNi, AlTiNi, TiAlN, CrN/CrC/(Mo, W)S2, TN/TiCN, AlTiN/MoS2, TiAlN, ZrN, whisker reinforced ceramics and combinations thereof. The strips 550 of material may span a length of the shoe. The strips 550 of material may also provide protection for a first or second lip 551, 552 of the shoe 300. A strip 550 of material may also be positioned at an end of the shoe 300 proximate the inlet 105 of the rotor assembly 101. In some embodiments, the strips may be segmented.

Figure 6:
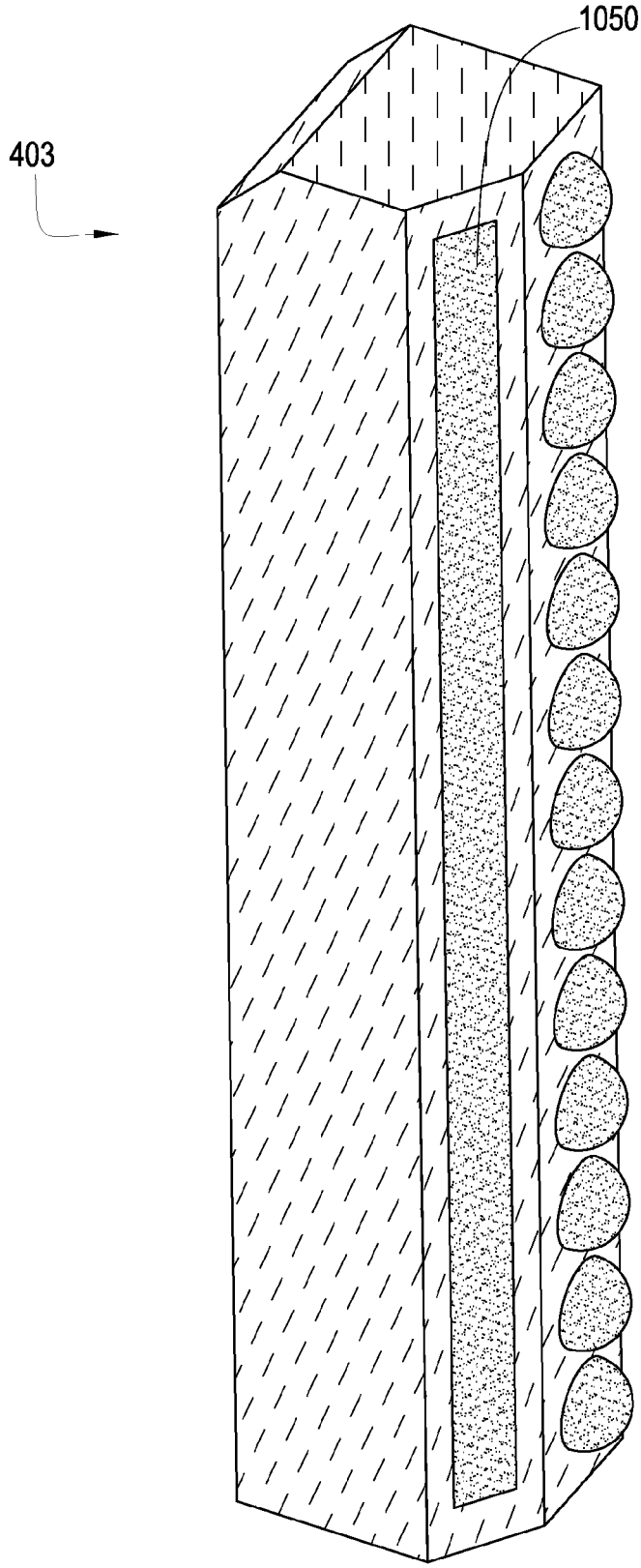
FIG. 6 is a perspective diagram of another embodiment of an edge.
Figure 9:
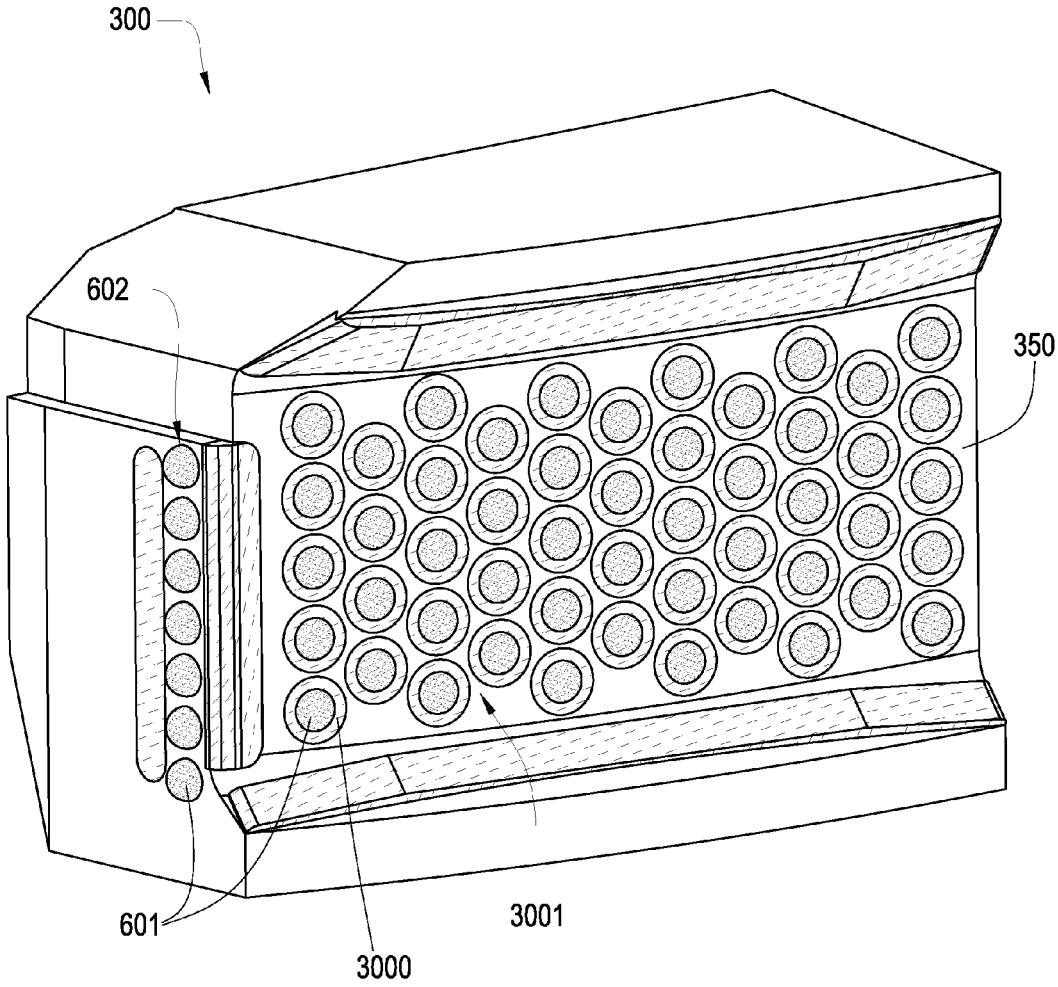
FIG. 9 is a perspective diagram of another embodiment of an impeller shoe.

Referring now to the embodiment of FIG. 9, the shoe 300 may also comprise at least one surface 350 made of a material selected from the group mentioned in FIG. 6. The material, in addition to the diamond surface 601, may provide extra wear protection for the surface 350 of the impeller shoe 300 along the wear path 202. Also disclosed in the FIG. 9 is at least one washer 3000 placed around the diamond surfaces 601. In embodiments where the impellor shoe is made of steel, spaces between the diamond surfaces may still be exposed to wear. A wear resistant washer 3000 may be brazed, press fit or otherwise fastened adjacent or around the diamond surface to minimize this wear. The washers 3000 may touch each other or they may have a gap 3001 between them. In some embodiments, the gaps 3001 are smaller than the average size of aggregate loaded into impactor.

Figure 10:
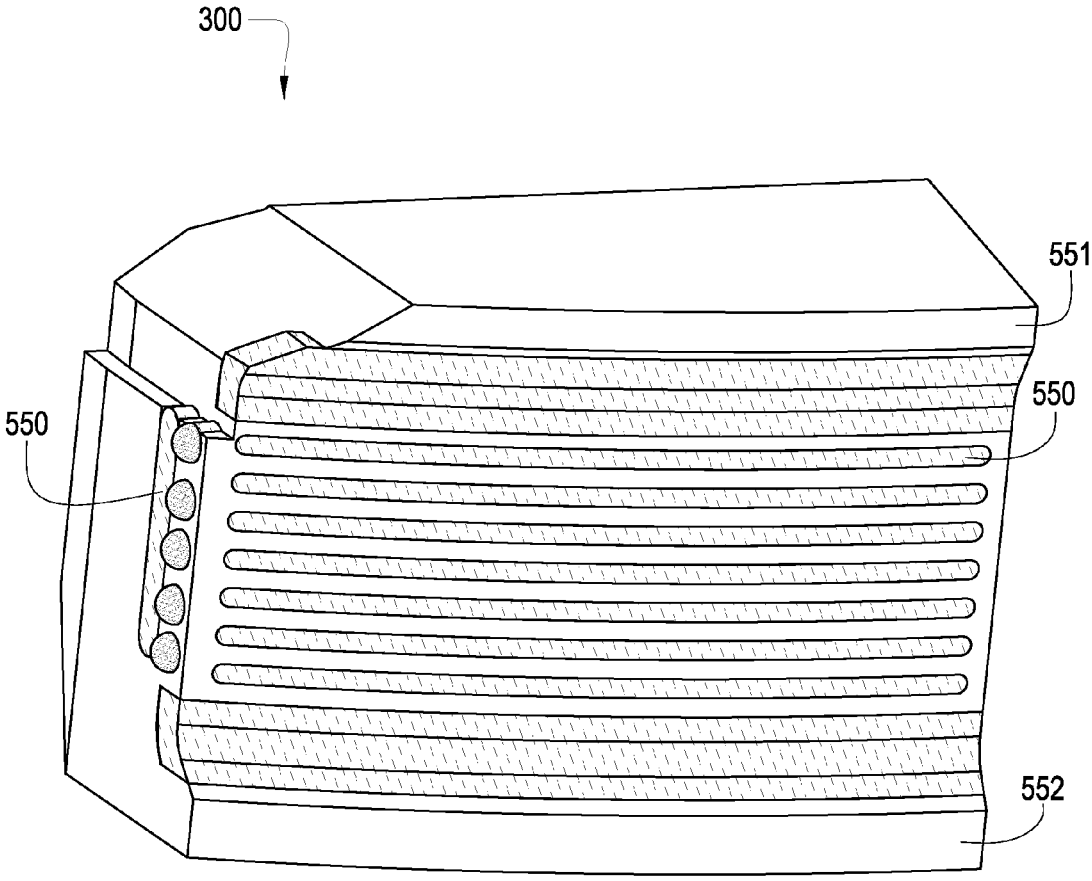
FIG. 10 is a perspective diagram of another embodiment of an impeller shoe.
Figure 11:
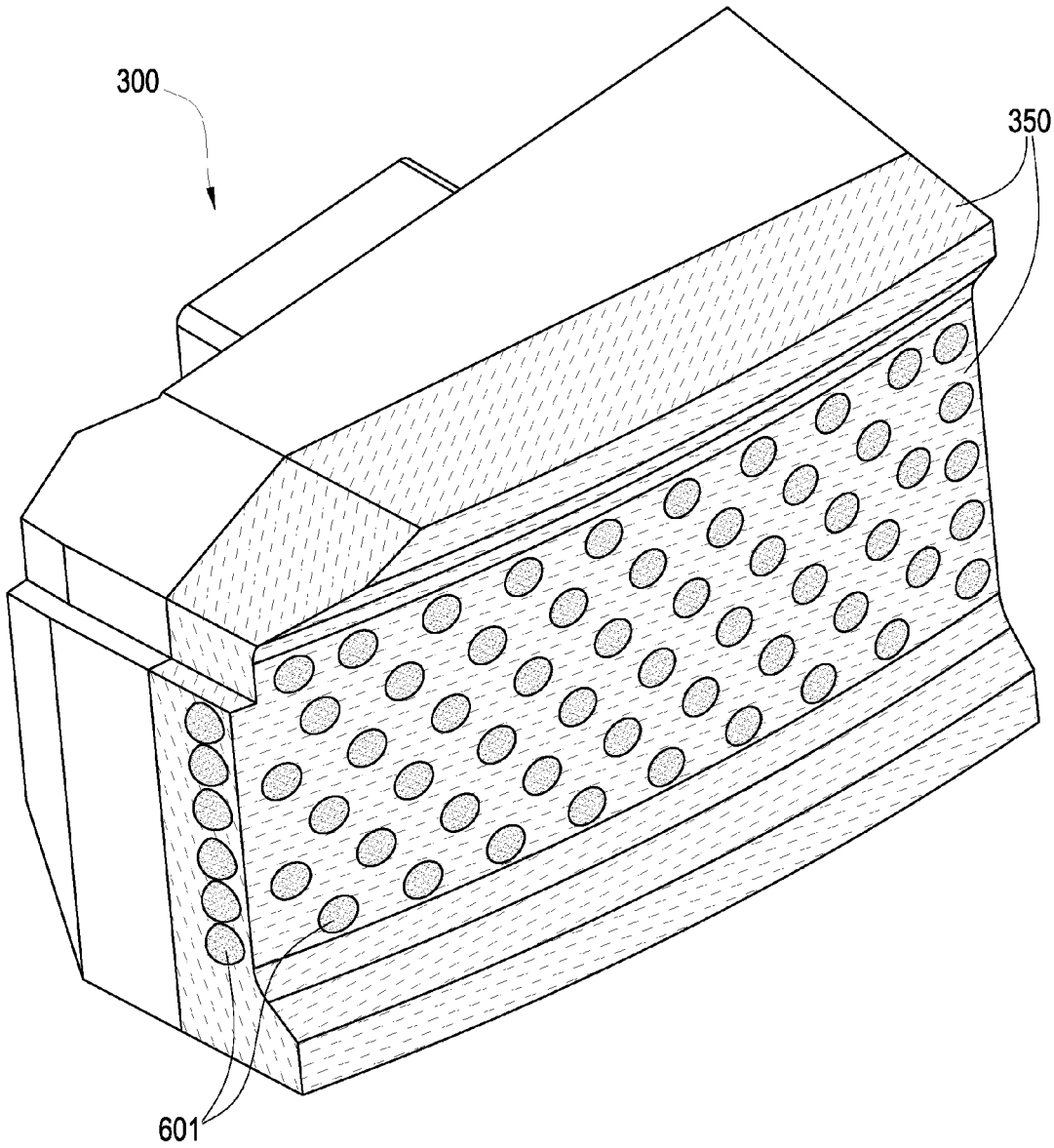
FIG. 11 is a perspective diagram of another embodiment of an impeller shoe.

FIG. 10 discloses a plurality of strips disposed lengthwise along the impeller shoe 300. FIG. 11, discloses surface 350 comprising a hard material such as carbide, a cemented metal carbide, tungsten carbide, diamond impregnated carbide, matrix, diamond impregnated matrix or combinations thereof. Inserts with diamond surfaces 601 are disposed within the surface. The hard surface 350 may be casted or molded prior to fastening and/or bonding it to the impeller shoe. Graphite or ceramics may be placed in the casted or molded material such that holes are formed in the surface and the inserts may be brazed or press fit into them.

Figure 12:
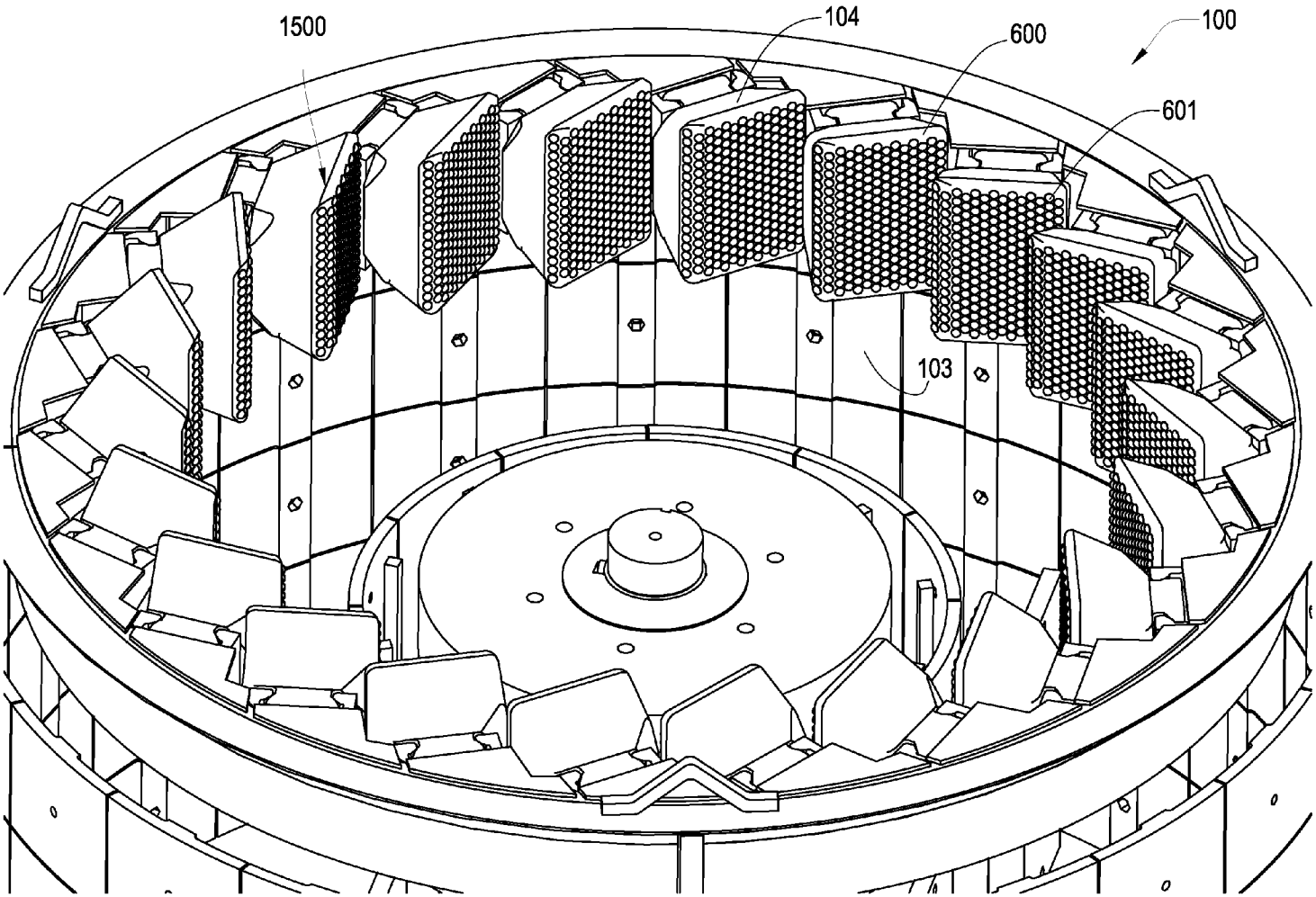
FIG. 12 is a perspective diagram of an embodiment of a plurality targets.

FIG. 12 discloses a plurality of targets shown without the rotary assembly for clarity. A face 600 of the targets 104 may comprise a diamond surface 601 in the wear path The diamond surface 601 may be attached to an insert 602. The insert 602 may be brazed or press fit into a recess formed in the targets 104. The insert 602 may protrude beyond the face of the targets 104 by 0.010 to 3.00 inches, or the insert may be flush with the face 600. The insert 602 may be bonded to a rounded or sharp corner 1500 joining at least two surfaces of the targets 104. The targets 104 may comprise a plurality of inserts 602 positioned on the targets 104 in staggered rows.

Figure 13:
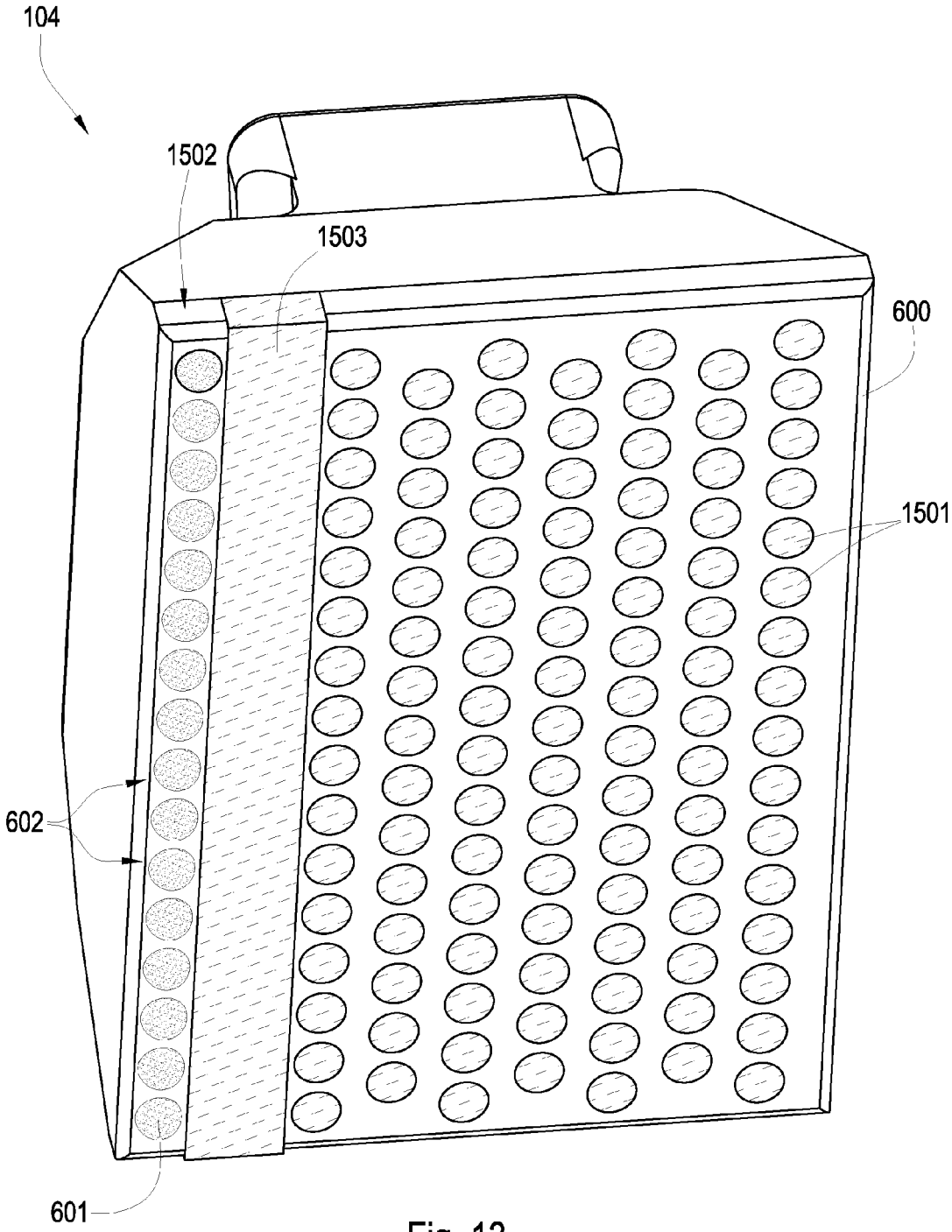
FIG. 13 is a perspective diagram of an embodiment of a target.
Figure 14:
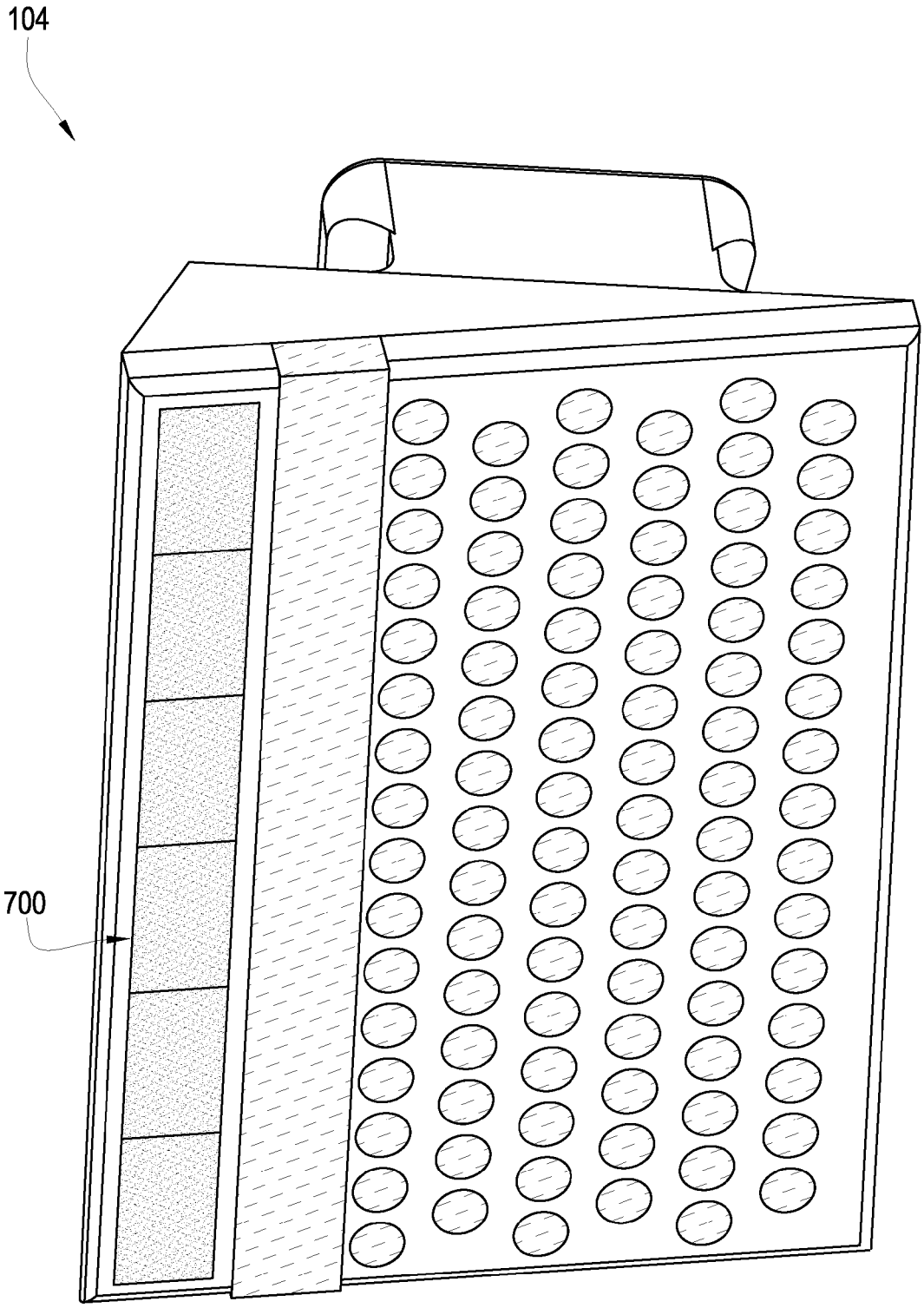
FIG. 14 is a perspective diagram of another embodiment of a target.
Figure 15:
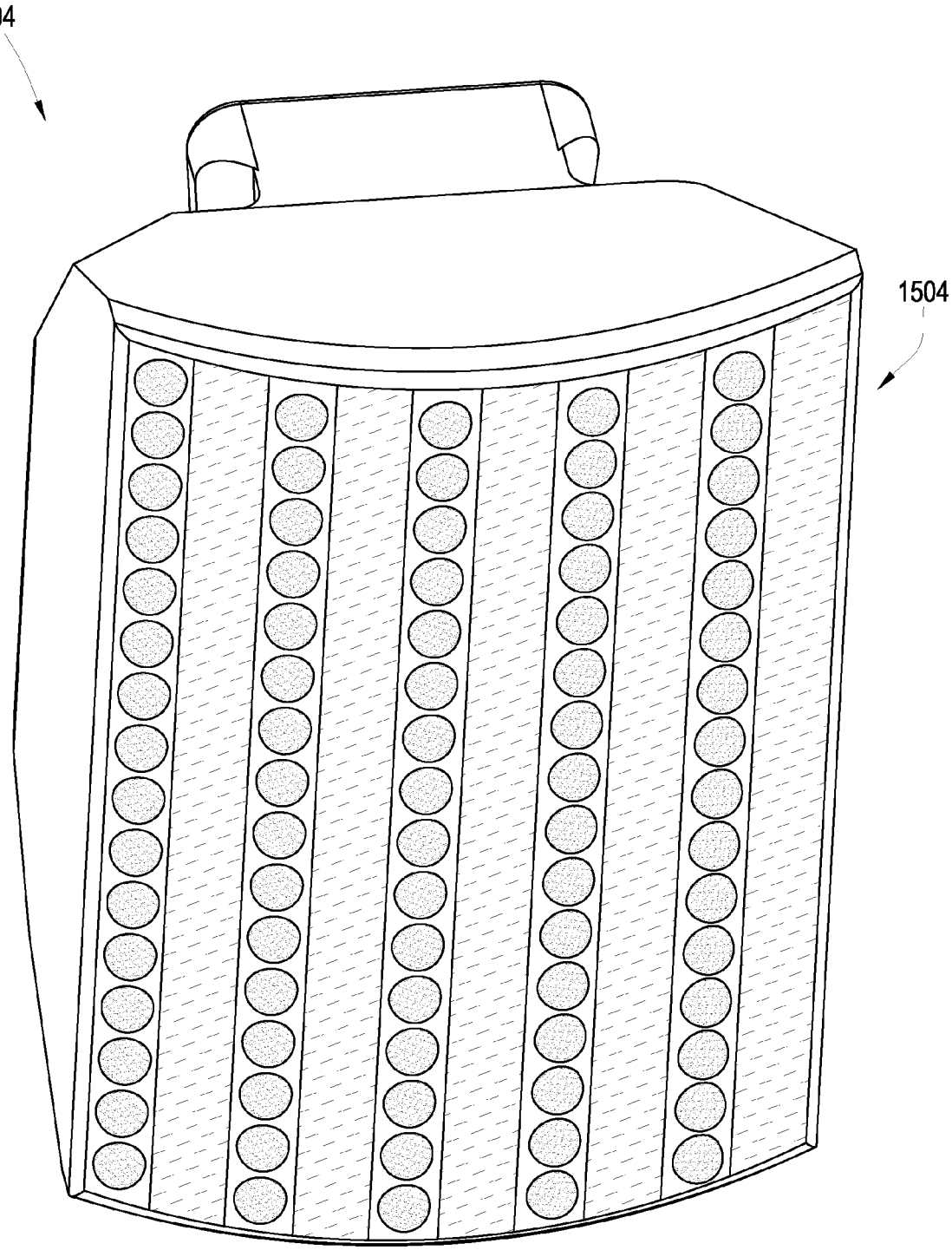
FIG. 15 is a perspective diagram of another embodiment of a target.
Figure 16:
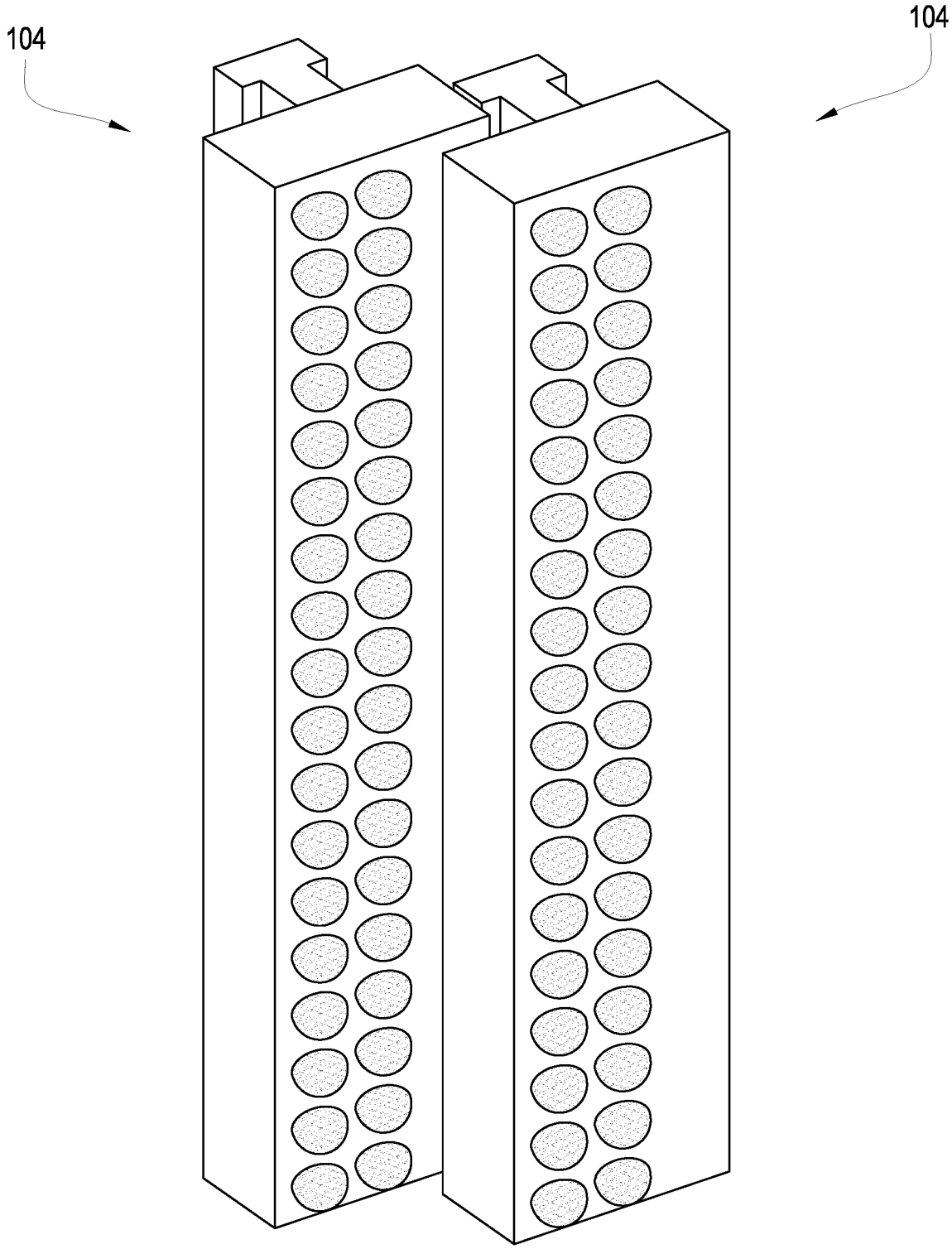
FIG. 16 is a perspective diagram of another embodiment of a target.

The targets 104 may also comprise one or more strips 1503 that span a length of the targets 104, as shown in the embodiment of FIG. 13. The inserts may be arranged in any pattern along the face 600 of the targets 104. The targets 104 may also comprise a ceramic or other metal softer than diamond, such as chromium, tungsten, tantalum, niobium, titanium, molybdenum, carbide, cubic boron nitride, TiN, AlNi, AlTiNi, TiAlN, CrN/CrC/(Mo, W)S2, TN/TiCN, AlTiN/MoS2, TiAlN, ZrN, or combinations thereof. Other inserts 1501 may be bonded or fixed to the target that do not comprise diamond surfaces, but still comprise hard materials. This may be a cheaper alternative since most of the wear may be concentrated to near an edge 1502 and may require a cheaper material. Rectangular inserts 700 are disposed along the edge 1502. FIG. 15 discloses a target 104 with a convex surface 1504 alternating between hard strips and rows of inserts. FIG. 16 discloses a plurality of smaller targets 104.

Figure 17:
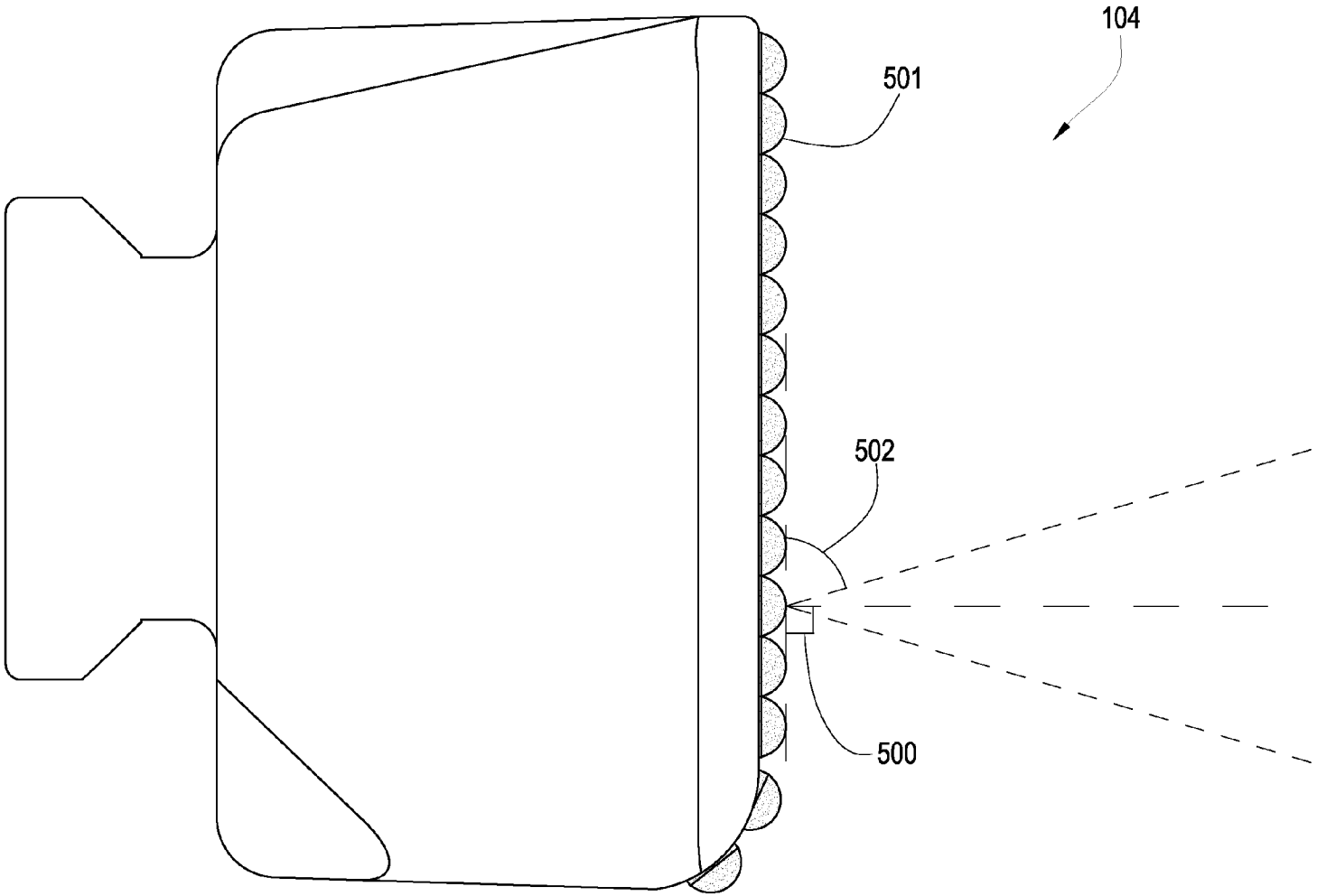
FIG. 17 is a top diagram of another embodiment of a target.
Figure 18:
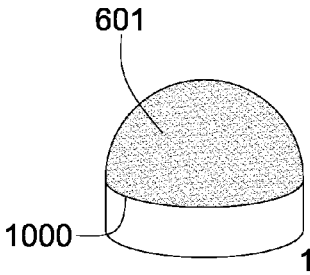
FIG. 18 is a perspective diagram of an embodiment of an insert.
Figure 19:
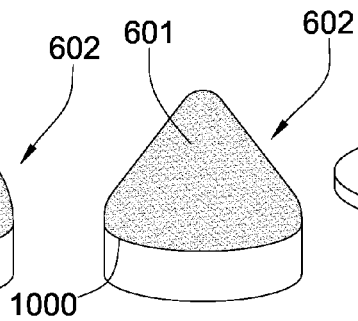
FIG. 19 is a perspective diagram of another embodiment of an insert.

Referring to FIG. 17, the plurality of targets 104 may be oriented such that the aggregate impacts the targets 104 at an angle 500 generally normal to a surface 501 of the targets 104, or the aggregate may impact the target 104 at an angle 502 other than a substantially normal angle. Aggregate impacting the surface 501 of the target 104 at an angle 502 other than substantially normal are believed to cause less wear on the target 104 because of lower impact force, although there may be a tradeoff in that a lower impact force may not reduce the size of the aggregate as much as desired, but in some embodiments, aggregate may not need the maximum impact force to realize the desired aggregate size. Each target 104 may be oriented at a different angle along the inner wall 103. Angled inserts may be positioned along the impellor shoe and/or the edges disclosed in FIGS. 4-6.

In some embodiments the inserts may protrude out of the target and when the aggregate impacts against the protrusion the aggregate is subjected to a bending force which may help increase the size reduction of aggregate and/or lower the energy requirements of the rotary shaft impactor. In some embodiments, the protruding inserts may be spaced according to the desired reduced aggregate size. In such embodiments, it is believed that the spacing of the inserts will affect the final aggregate size and may improved the useable amount of aggregate reduced by the impactor.

FIGS. 18 to 26 are different embodiments of the insert 602. The insert 602 may comprise a geometry with a generally domed shape, as in the embodiment of FIG. 18; a generally conical shape, as in the embodiment of FIG. 19; a generally flat shape, as in the embodiment of FIG. 20; a generally pyramidal shape, as in the embodiment of FIG. 21; a generally paraboloid shape, as in the embodiment of FIG. 22; a generally frustoconical shape, as in the embodiment of FIG. 23; an elliptical wedge shape, as in the embodiment of FIG. 24; a generally scoop shape, as in the embodiment of FIG. 25; a rectangular wedge shape, as in the embodiment of FIG. 26; a generally asymmetric shape; a generally rounded shape; a generally polygonal shape; a generally triangular shape; a generally rectangular shape; a generally concave shape; a generally convex shape; a chamfer; a conic section; or combinations thereof. The diamond surface 601 may be bonded to a substrate in a high temperature high pressure press at a planar or non-planar interface 1000 of the insert 602. Preferably the diamond surface is a cobalt infiltrated polycrystalline diamond bonded to a tungsten carbide substrate.

Figure 20:
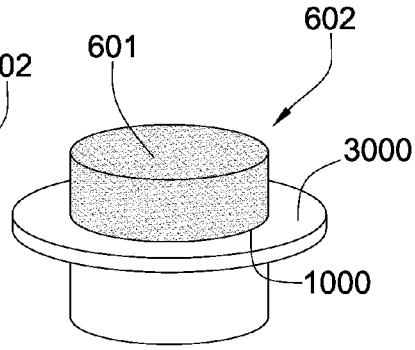
FIG. 20 is a perspective diagram of another embodiment of an insert.
Figure 21:
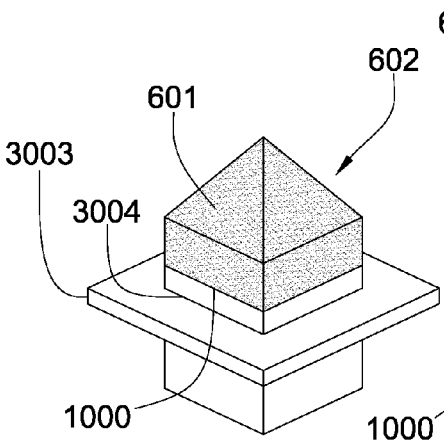
FIG. 21 is a perspective diagram of another embodiment of an insert.
Figure 22:
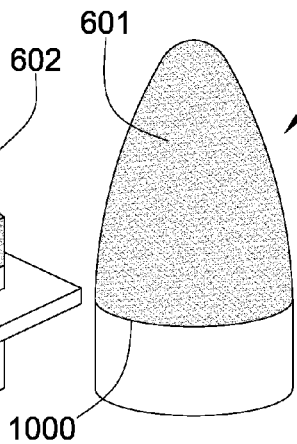
FIG. 22 is a perspective diagram of another embodiment of an insert.
Figure 23:
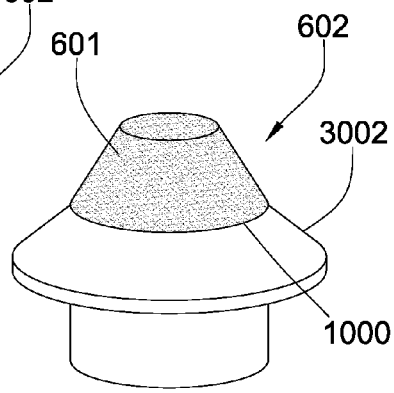
FIG. 23 is a perspective diagram of another embodiment of an insert.
Figure 24:
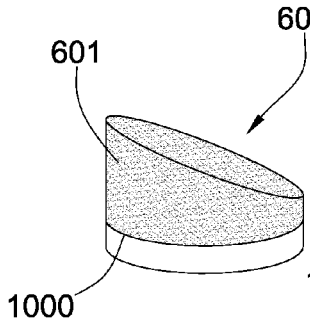
FIG. 24 is a perspective diagram of another embodiment of an insert.
Figure 25:
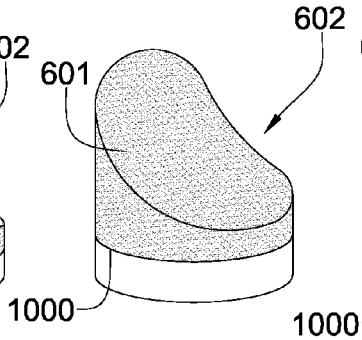
FIG. 25 is a perspective diagram of another embodiment of an insert.
Figure 26:
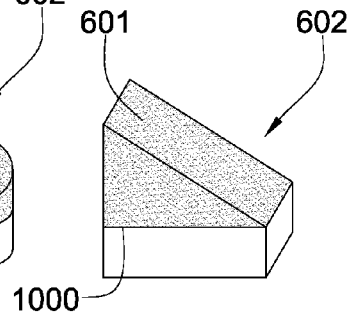
FIG. 26 is a perspective diagram of another embodiment of an insert.

FIGS. 20, 21, and 23 disclose various geometries of washers 3000 that may be disposed around the inserts 602. Preferably these materials are selected from materials with a hardness greater than 60 HRc like tungsten carbide, hard chromium, hard and ceramics. The inner perimeter 3004 or the outer perimeter 3004 of the washer may comprise any shape or size, such as circular shapes, rectangular shapes, triangular shapes, hexagonal shapes, polygonal shapes, or combinations thereof. FIG. 23 discloses a washer with a taper surface 3002.

Whereas the present invention has been described in particular relation to the drawings attached hereto, it should be understood that other and further modifications apart from those shown or suggested herein, may be made within the scope and spirit of the present invention.

What is claimed is:

1. A rotary shaft impactor, comprising:

a rotor assembly connected to a rotary driving mechanism;

the rotor assembly comprising an axis of rotation, an inlet, and an outlet, and being disposed within a chamber with an inner wall;

a wear path comprising a portion of the inner wall and a channel connecting the inlet and the outlet;

the inner wall comprising at least one target with a face configured for impacts from accelerated aggregate existing the outlet; and the face comprising an insert with a carbide substrate bonded to a diamond surface;

the diamond surface comprising a rounded shape that protrudes from a surface of the target, and the insert is configured to break the accelerated aggregate through bending forces.

2. The rotary shaft impactor of claim 1, wherein the insert is on a corner of the target, the corner joining at least two surfaces of the target.

3. The rotary shaft impactor of claim 2, wherein the corner is rounded.

4. The rotary shaft impactor of claim 2, wherein the corner is sharp.

5. The rotary shaft impactor of claim 1, wherein the face target also comprises at least one strip of hard material that spans a length of the target.

6. The rotary shaft impactor of claim 1, wherein the face comprises a pattern of alternating hard strips and rows of inserts.

7. The rotary shaft impactor of claim 1, wherein the insert comprises a generally conical shape.

8. The rotary shaft impactor of claim 1, wherein a plurality of inserts are positioned in the wear path in staggered rows on the face of the target.

9. The rotary shaft impactor of claim 1, wherein the insert protrudes beyond the face by 0.010 to 3.00 inches.

10. The rotary shaft impactor of claim 1, wherein the insert is brazed or press fit into a recess formed in the face.

11. The rotary shaft impactor of claim 1, wherein the diamond surface is bonded to a non-planar interface of the insert.

12. The rotary shaft impactor of claim 1, wherein the target comprises a convex surface.

13. The rotary shaft impactor of claim 1, wherein a washer is disposed adjacent the diamond surface.

14. The rotary shaft impactor of claim 13, wherein the washer comprises a tapered surface.

* * * * *